US006374646B1

(12) United States Patent
Brake

(10) Patent No.: US 6,374,646 B1
(45) Date of Patent: Apr. 23, 2002

(54) PADLOCK SECURITY CAP

(76) Inventor: Donald L. Brake, 312 Haymarket St., W. Jefferson, OH (US) 43162

( * ) Notice: Subject to any disclaimer, the term of this patent is extended or adjusted under 35 U.S.C. 154(b) by 0 days.

(21) Appl. No.: 09/733,135

(22) Filed: Dec. 8, 2000

(51) Int. Cl.[7] ..... E05B 67/38
(52) U.S. Cl. ..... 70/56; 70/54; 292/DIG. 68
(58) Field of Search ..... 70/53–56, DIG. 56; 292/DIG. 68

(56) References Cited

U.S. PATENT DOCUMENTS

| | | | | | |
|---|---|---|---|---|---|
| 2,541,638 | A | * | 2/1951 | Clevett | 70/56 |
| 3,453,846 | A | * | 7/1969 | Owen et al. | 70/54 |
| 3,482,422 | A | * | 12/1969 | Cornwell | 292/DIG. 68 X |
| 3,637,246 | A | * | 1/1972 | Leiter | 292/DIG. 68 X |
| 3,783,657 | A | * | 1/1974 | Foote | 70/54 X |
| 4,300,370 | A | * | 11/1981 | Kaiser et al. | 70/54 |
| 4,534,190 | A | * | 8/1985 | Stanich | 70/54 |
| 4,882,918 | A | * | 11/1989 | Stanich | 70/54 |
| 5,303,568 | A | * | 4/1994 | Wightman | 70/54 X |
| 5,655,391 | A | * | 8/1997 | Long | 70/56 |

FOREIGN PATENT DOCUMENTS

| | | | | |
|---|---|---|---|---|
| DE | 348575 | * | 2/1922 | 70/54 |
| GB | 8264 | * | 8/1901 | 70/54 |
| IT | 415745 | * | 12/1946 | 70/54 |

* cited by examiner

*Primary Examiner*—Suzanne Dino Barrett
(74) *Attorney, Agent, or Firm*—Thomas S. Baker, Jr.

(57) ABSTRACT

A conventional personal storage locker unit padlock assembly having a padlock body and a padlock shackle is combined with a separate unitary padlock cap that co-operates with the padlock body and the padlock shackle hinge and latch arms and that functions to substantially reduce the open area defined by the padlock shackle and co-operating padlock body to thereby enhance the theft security capability otherwise provided by the padlock assembly alone.

2 Claims, 2 Drawing Sheets

PADLOCK SECURITY CAP

CROSS-REFERENCES

None.

FIELD OF THE INVENTION

The present invention relates generally to padlocks, and particularly concerns a padlock and padlock cap combination that may be advantageously utilized in locking conventional personal storage locker units to enhance locker security against theft.

BACKGROUND OF THE INVENTION

The use of personal storage lockers is widespread in the United States, especially in connection with schools, factories, and other places or institutions having large-scale attendance or employment of persons. Such storage lockers are typically substantially constructed of sheet metal and are provided with a closure latch mechanism that readily accepts a conventional padlock device to obtain a satisfactory level of security against storage locker break-in and theft of contents. A padlock device may be operated by a combination lock mechanism or a key lock mechanism.

It is well-known that such conventional padlock devices may be readily breached by skilled and determined individuals using a tool such as a pry bar, hammer or a tool such as a lock shim pick. In such cases the pry bar is usually easily inserted into the open space defined by the padlock shackle configuration interior prior to forcefully prying the padlock body from locked engagement with the padlock shackle. In the case of using a lock shim pick, the lock shim pick is inserted into the padlock body interior from adjacent the entry opening of the padlock shackle latch arm into the padlock body interior. The hammer is used to strike the padlock body to cause it to separate from the padlock shackle.

Accordingly, a principal object of the present invention is to provide a padlock cap that may be readily combined with a conventional padlock prior to locking the padlock, the installed cap device preventing the subsequent insertion of a pry bar within the space defined by the padlock closed shackle, deflecting hammer blows to the padlock body and also preventing insertion of a lock pick shim into the padlock body interior from adjacent the entry opening of the padlock shackle into the padlock body.

Other objects and advantages of the present invention will become apparent during consideration of the detailed descriptions, drawings, and claims which follow.

SUMMARY OF THE INVENTION

The padlock cap of the present invention is formed to have a padlock body recess that cooperates with the body of a conventional padlock. The cap padlock body recess is defined by a segment-shaped cap back, by an annular-shaped cap front, and by a cap top which joins the cap back to the cap front in spaced-apart relation and which has a thickness that precludes theft tool entry into the padlock body interior and into the padlock shackle interior. The top of the padlock is provided with both a shackle hinge arm entry and a spaced-apart, separate shackle latch arm entry. Both padlock cap top arm entries are provided with a closed perimeter. However, the cap top shackle latch arm entry is provided with an adjacent top surface relief or undercut that facilitates lateral movement of the padlock shackle latch arm as it is moved toward engagement with its entry opening.

From a procedure standpoint, and with the padlock cap in an inverted condition, the top shackle hinge arm entry of the padlock cap is first threaded over the shackle latch arm of the opened padlock, then over the shackle connecting arch, and subsequently over the shackle hinge arm and into co-operative engagement with the body of the opened padlock device. Next the shackle latch arm of the opened padlock device and the padlock shackle connecting arch are successively threaded into the door latch subassembly of the co-operating personal storage locker. Lastly the padlock body is rotated about the padlock shackle hinge arm sufficient to bring the padlock shackle latch arm into proper engagement with its bore in the padlock body, and the padlock shackle arms forced into the padlock body interior to complete the padlock locking operation.

DETAILED DESCRIPTION

Figure 1:
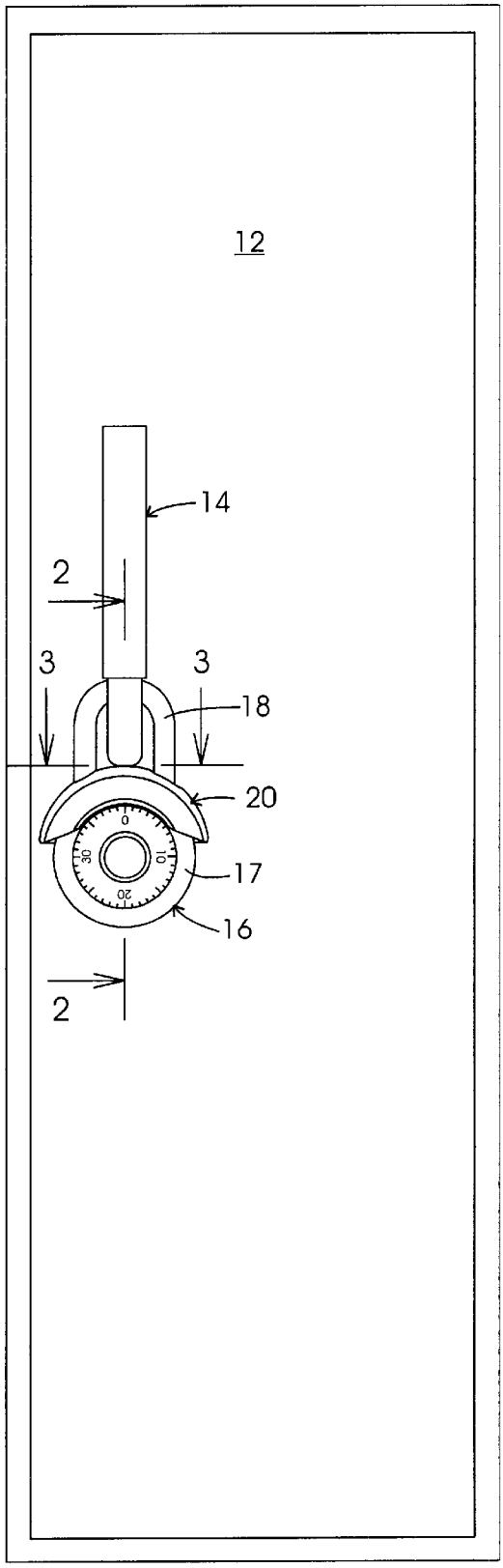
FIG. 1 is a front elevation view of a typical personal storage locker unit having a conventional combination padlock device installed in its door latch subassembly, the padlock device further having a preferred embodiment of the padlock cap of the present invention combined therewith.

FIG. 1 illustrates the front of a personal storage locker unit 10 that has a typical door 12 provided with a conventional door handle and door latch subassembly 14 which is designed to receive a standard state-of-the-art or conventional padlock device 16. Conventional padlock device 16 has a padlock body 17 and a padlock shackle 18 engaged with subassembly 14 in locking relation, and carries the properly installed padlock cap 20 of the present invention.

Figure 2:
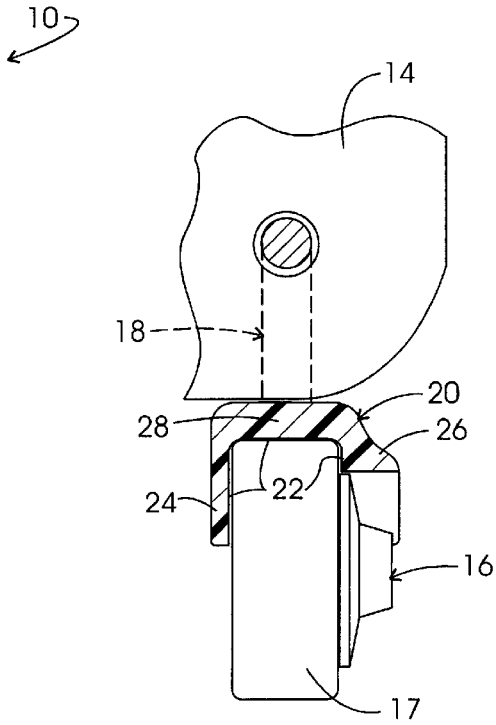
FIG. 2 is a section view taken at line 2—2 of FIG. 1.
Figure 3:
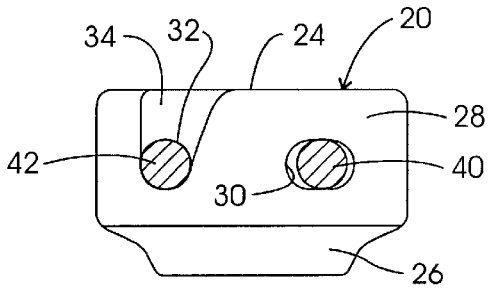
FIG. 3 is a section view taken at line 3—3 of FIG. 1.

Referring to FIGS. 2 and 3, padlock cap 20 has a recess 22 that is basically defined by segment-shaped cap back 24, by annulus-shaped cap front 26, and by cap top 28 which essentially joins cap back 24 to cap front 26 in spaced-apart relation. It is preferred that padlock cap 20 be made by the injection molding of a conventional plastic resin or by the casting of a molten metal such as a common zinc-base die cast alloy.

As illustrated in FIG. 3, cap top 28 is provided with two entry openings 30 and 32. Entry opening 30 has a closed perimeter and is sized to accommodate shackle hinge arm 40 during placement of padlock cap 20 on padlock body 17. Entry opening 32 in padlock cap 20 also has a closed perimeter and is sized to just accommodate shackle latch arm 42, and in addition is provided with a relief or top surface undercut 34 that will accommodate the free end of shackle latch arm 42 as it is rotated during rotation of shackle hinge arm 40 into proper alignment with top entry 32. Shackle arch 44 joins shackle arms 40 and 42 together.

Figure 4:
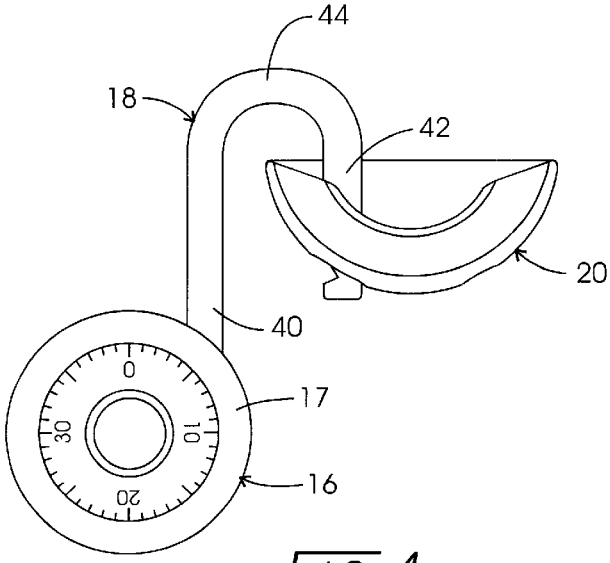
FIGS. 4 through 6 illustrate the preferred steps of combining the padlock cap of the present invention with a conventional combination padlock device.
Figure 6:
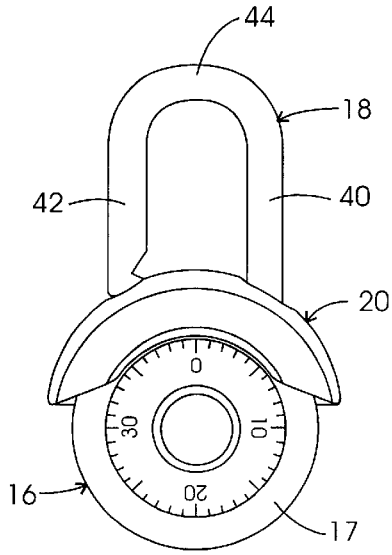
Figure 5:
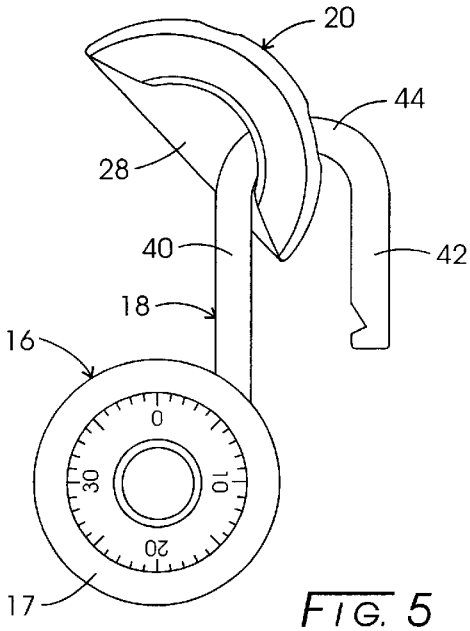
Figure 7:
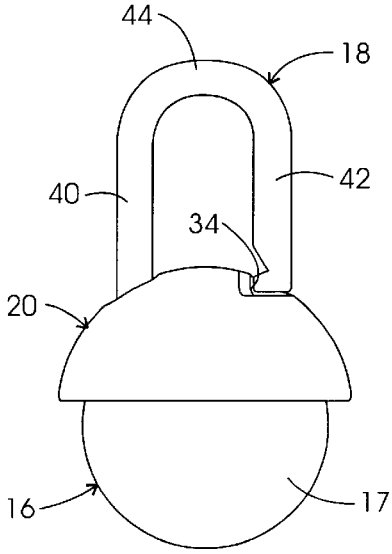
FIG. 7 is a reverse view of FIG. 6.

FIGS. 4 through 6 also illustrate the method of properly installing padlock cap 20 and padlock 16 in door handle/latch subassembly 14. From a procedure standpoint, and with the padlock cap 20 in an inverted condition (see FIG. 4), the top shackle hinge arm entry 30 of the padlock cap is first threaded over the free end of shackle latch arm 42 of the opened padlock, then over the shackle connecting arch 44, and subsequently over shackle hinge arm 40 and into co-operative engagement with the body 17 of the opened padlock device 16. Next the free end of shackle latch arm 42 of the opened padlock device and padlock shackle connecting arch 44 are successively threaded into the lock opening of door latch subassembly 14 of the personal storage locker unit door 12. Lastly, the body of padlock 16 is rotated about padlock shackle hinge arm 40 to pass the free end of shackle latch arm 42 through relief 34 and bring the padlock shackle latch arm 42 into proper alignment with its bore in the padlock body, and the padlock shackle arms are forced into the padlock body interior by closing the padlock to complete the padlock locking operation.

Various changes may be made to the configuration, size, and materials of construction of the various elements detailed in the above specification and in the drawings without departing from the meaning, scope, or intention of the claims which follow.

What is claimed is:

1. A padlock cap for co-operation with a padlock having a padlock body and a padlock shackle provided with a shackle hinge arm projecting front the padlock body and with a rotatable shackle latch arm that is a continuation of the shackle hinge arm, in combination:

a unitary cap body heaving a padlock body recess that is defined by a cap back, by a cap front, and by a cap top which joins said cap back to said cap front in spaced-apart relation;

a cap padlock shackle hinge arm through-opening in said cap top; and a cap padlock shackle latch arm closed perimeter through-opening in said cap top and positioned in spaced-apart relation to said cap padlock shackle hinge arm through-opening, said cap padlock shackle latch arm closed perimeter through opening having a closed perimeter that is sized and configured to just slidably accept a padlock shackle arm, and said cap top having an undercut entry relief that extends contiguously and laterally from adjacent said cap padlock shackle latch arm closed perimeter through-opening to accommodate the free end of the padlock shackle latch arm during rotation.

2. In a storage locker unit having a door latch mechanism and a door latch extension lock opening in the door latch mechanism that receives a padlock shackle, in combination:

a padlock assembly having a padlock body and a co-operating padlock shackle provided with a shackle hinge arm projecting from the padlock body and with a rotatable shackle latch arm that is a continuation of the shackle hinge arm that can be inserted into the storage locker unit door latch extension lock opening;

a padlock cap body having a padlock body recess defined by a cap front, a cap back, and a cap top which joins said cap back to said cap front in spaced-apart relation;

a cap padlock shackle hinge arm through-opening in said padlock cap top; and a cap padlock shackle latch arm closed perimeter through-opening in said padlock cap top and spaced apart from said cap padlock shackle hinge arm through-opening by a distance equal to the distance between said padlock shackle hinge arm and said padlock shackle latch arm, said cap padlock shackle latch arm closed perimeter through opening having a closed perimeter that is sized and configured to just slidably accept a padlock shackle arm, said cap top having an undercut entry relief that extends contiguously and laterally from adjacent said cap padlock shackle latch arm closed perimeter through opening to accommodate the free end of the padlock shackle latch arm during rotation, said padlock assembly padlock shackle hinge and latch arms respectively passing through said cap padlock shackle hinge arm through-opening and cap padlock shackle latch arm closed perimeter through-opening, said padlock assembly padlock shackle passing through the personal storage locker unit door latch extension lock opening, and said padlock assembly padlock body being at least partially contained within said padlock cap body recess, whereby the spatial zone located between the storage locker unit door latch extension lock opening sand said padlock assembly padlock body is substantially closed by the thickness of said padlock cap top.

* * * * *